United States Patent [19]

Konsuvo

[11] Patent Number: 4,744,762

[45] Date of Patent: May 17, 1988

[54] COLLAPSIBLE WRITING BOARD DEVICE

[76] Inventor: Nicholas P. Konsuvo, 6330 Genesse, San Diego, Calif. 92112

[21] Appl. No.: 31,036

[22] Filed: Mar. 27, 1987

[51] Int. Cl.[4] ..... B43L 1/00

[52] U.S. Cl. ..... 434/412

[58] Field of Search ..... 434/412

[56] References Cited

U.S. PATENT DOCUMENTS 3,587,183 6/1971 Davis ..... 434/412

FOREIGN PATENT DOCUMENTS 400771 11/1933 United Kingdom ..... 434/412

*Primary Examiner*—Gregory E. McNeill

*Attorney, Agent, or Firm*—Frank D. Gilliam

[57] ABSTRACT

A writing board structure which can be folded in half length wise and reduced in height for storage and quickly and easily returned to its normal use condition. Wnen in a normal use condition the writing board surface can be selectively adjusted for height and angle relative to its supporting surface.

15 Claims, 3 Drawing Sheets

COLLAPSIBLE WRITING BOARD DEVICE

BACKGROUND OF THE INVENTION

This invention is directed to devices which have writing surfaces and more particularly to collapsible writing devices such as blackboards and various easel type devices which include means for providing a continuous length of writing material over the writing surface.

Prior art devices that teach blackboard type devices which include continuous lengths of writing material positionable on the writing surface by using roller means on the top and bottom of the writing surface can be found in the following U.S. Pat. Nos.: 483,371; 524,617; 634,149 and 794,653.

A collapsible blackboard with a fixed in place writing surface can be found in U.S. Pat. Nos. 2,109,723 and 2,456,103.

There is a continuing need for a collapsible blackboard or easel that can be folded and reduced in height for storage, that has an enlarged surface area of writing material which can be readily translated to present a clean or prior used surface for use or review.

SUMMARY OF THE INVENTION

This invention provides an improved blackboard or easel type device that can be folded about a vertical axis and reduced in height for convenient storage. The device is easily translatable along it support surfaces by ball casters. When ready for use, the device can be transported in its folded configuration to the place of use, unfolded, locked in operating position, elevated to a desired use height and tilted vertically to a desired use angle. and reduced in height for convenient storage. The device is easily translatable along it support surfaces by ball casters. When ready for use, the device can be transported in its folded configuration to the place of use, unfolded, locked in operating position, elevated to a desired use height and tilted vertically to a desired use angle.

When the device is used as a blackboard the writing surface is substantially vertical and when used as an easel or drawing board the writing surface can be rotated through about 90 degrees to any desired angle. The selected angle in then maintained by a novel locking system which can be quickly and easily released for re-positioning.

A pair of rollers, one on each horizontal end of the device provide a continuous roll of writing material as well as a take up roller for collecting the used writing material. The used writing material can be redisplayed as desired. Leaf springs are employed to maintain required tension to the writing material between the rollers spanning the writing surface. The writing material can be maintained between the rollers when the device is in a folded position.

With these and other features in mind, the invention consists in construction, arrangement and combination of the various parts of the invention whereby the features and objects contemplated are attained, as hereinafter more fully set forth, pointed out in the claims and illustrated in the accompanying drawings, wherein.

BRIEF DESCRIPTION OF THE DRAWING FIGURES

Figures

DETAILED DESCRIPTION OF THE DRAWING

Referring now to FIGS. 1–6, depicting different folded and use positions of the collapsible structure 10 which is capable of being folded into small a space and quickly and easily set up for the desired use.

Figure 1:
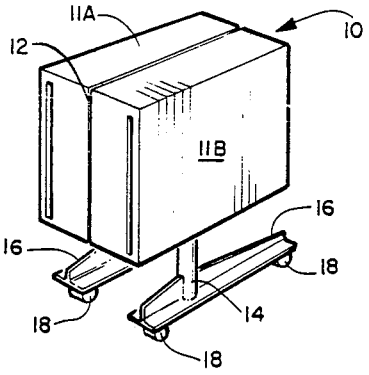
FIG. 1 is an elevated perspective showing of the blackboard/easel device of the Inventor in a folded support nonextended configuration.

For storage the collapsible structure 10 having surfaces portions 11A and 11B is folded about hinge 12 with the stands 14 telescoped down to their minimum length. The end of the stand include a base 16 with one or more caster type wheels 18 on each extended end. The base 16 is positioned off center with respect to its stand 14 connection to provide stability when folded as shown in FIG. 1 and well as in certain angle use positions.

Figure 2:
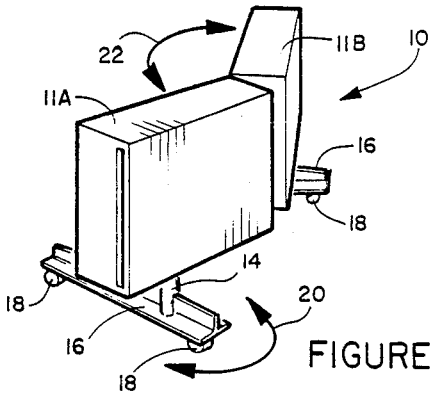
FIG. 2 is a showing of the FIG. 1 device intermediate the folded and unfolded positions.

FIG. 2 depicts the collapsible structure 10 which is collapsed by rotating surface portions of 11A and 11B about hinge 12 along arrows 20 and placed in a use position by rotation, about hinge 12 along arrows 22.

Figure 3:
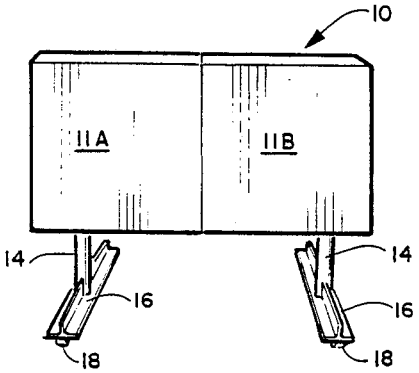
FIG. 3 is a showing of the FIG. 1 device in a fully open use position.

FIG. 3 depicts a fully displayed collapsible structure 10 with stands 14 in their collapsed minimum length position.

Figure 4:
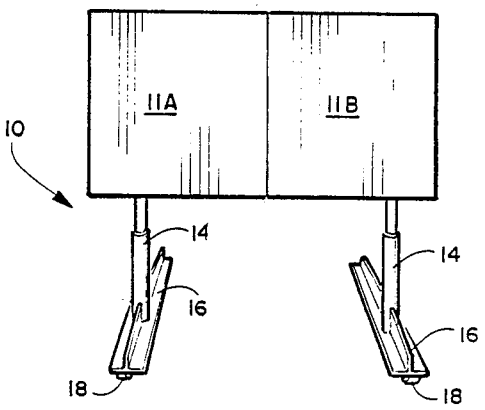
FIG. 4 is a showing of the device of FIG. 1 unfolded for use with the support legs extended.

FIG. 4 depicts the collapsible structure 10 fully disployed with the stands 14 suitably extended in length.

Figure 5:
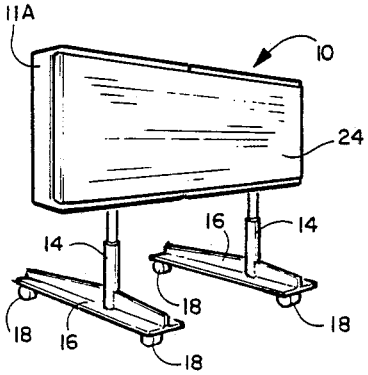
FIG. 5 is a showing of the device of FIG. 1 in a use position with writing material extended from side to side.

FIG. 5 is a showing of the collapsible structure 10 in the FIG. 4 position with a translatable writing surface 24 in place. The writing surface 24 and operating mechanism will be more fully explained hereinafter.

Figure 6:
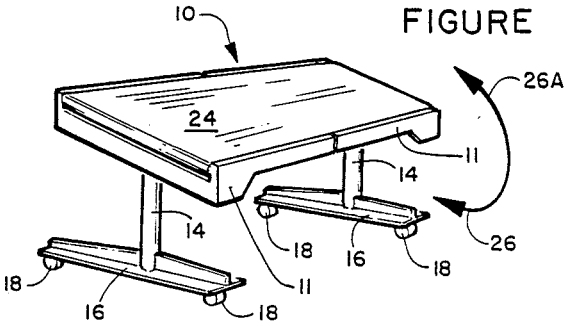
FIG. 6 is a showing of the FIG. 1 device with the writing surface tilted for use as an easel or drawing board.

FIG. 6 depicts the structure 10 of FIG. 5 with the surface 24 tilted for use as a drafting table or the like with the length of the stands 14 shortened for the purpose.

Figure 7:
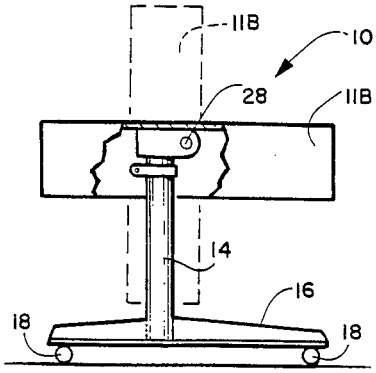
FIG. 7 is an end showing of the device in the FIG. 6 position.

FIG. 7 is a cut away showing of an end view of the structure positioned as in FIG. 6 with a phantom showing of the FIG. 3 position prior to tilting, i.e. the stands 14 have been shortened from the FIG. 4 and FIG. 5 showing. The surface 24 is tilted about pivot 28 of bracket 30.

Figure 8:
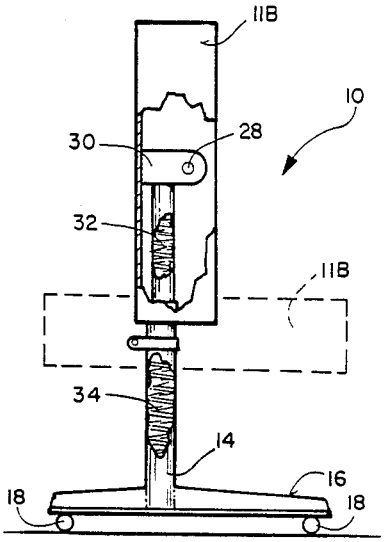
FIG. 8 is an end showing of the device in the FIG. 5 position, cut away to show the counter balance spring.

FIG. 8 is a cut away showing similar to FIG. 6 with the surface 24 in a vertical position with a phantom showing of the horizontal or tilted position. Counter balance springs 32 and 34 and clamp 36 for fixing the length of stands 4 are shown.

Figures 9, 11:
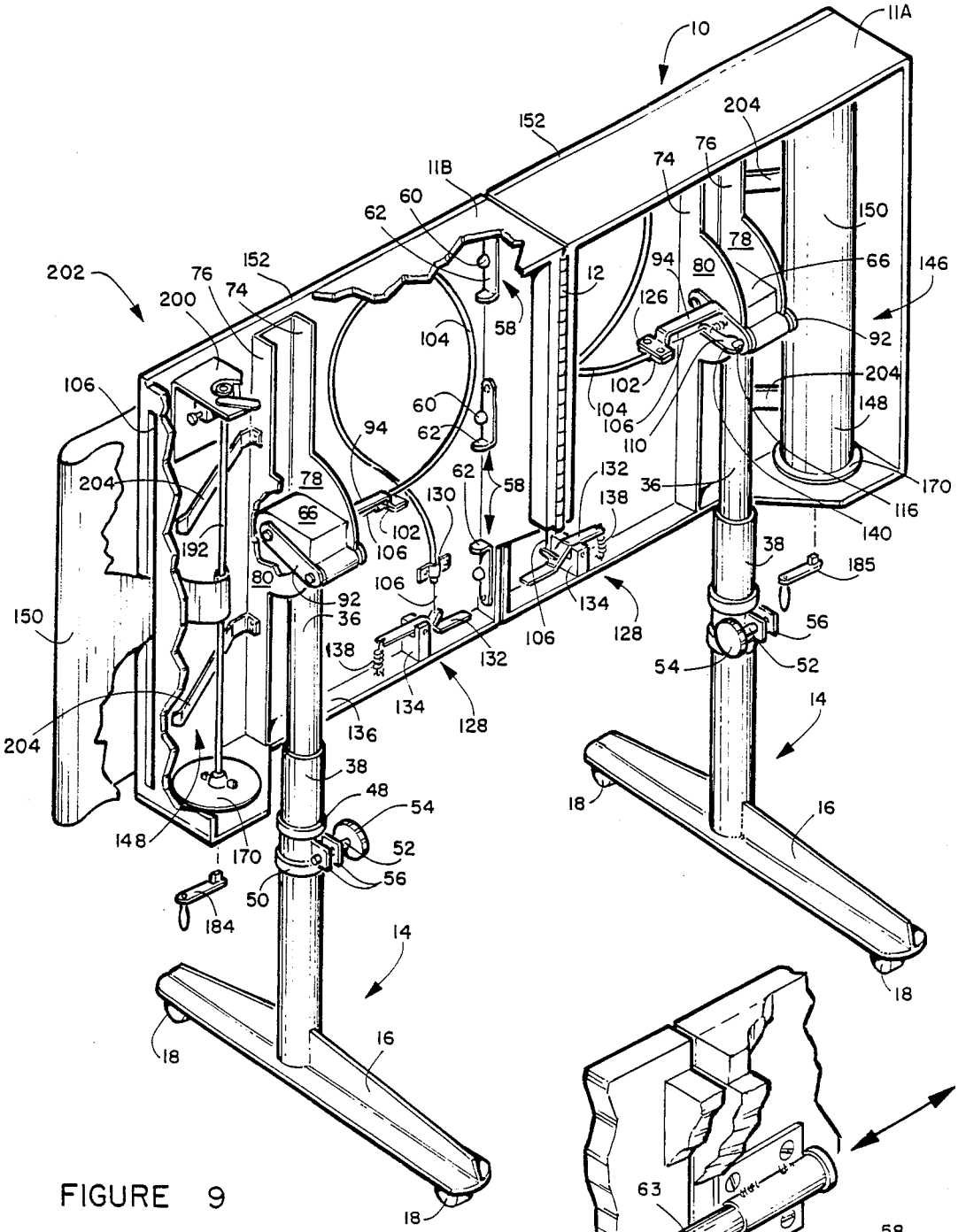
FIG. 9 is an elevated perspective showing of the back of this device in the FIG. 5 position.
FIG. 11 is a detail showing of the locking mechanism of the FIG. 9 showing.

FIG. 9 is a showing of the rear of the device.

Figure 10:
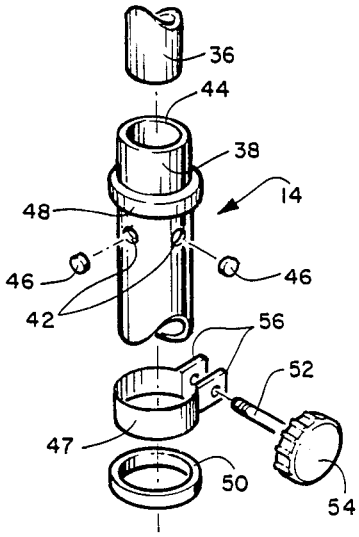
FIG. 10 is a detail of the FIG. 9 showing depicting the telescoping leg locking mechanism.

Referring now to FIG. 10, a section of stand 14 is shown including the positioning lock mechanism. The stand 4 comprises an upper tube portion 36 which will fits into a lower tube portion 38. A spring 32 is captured between the upper closed end of the upper tube and the closed bottom portion of the lower tube. Spring 32 acts as a counter balance to the weight of the portions 11A and 11B. The lower tube portion 38 includes a plurality of space apart openings 42 (two shown) near the top end surface 44. A lock disk or pad 46 is positioned in each of the openings 42. The disk or pad 46 has a width greater than the wall thickness of the lower tube portion 38 and has a slightly smaller diameter than the opening 42. This size difference allows the disk or pad 46 to move freely within the opening. A clamp 46 surrounds and covers the openings 42 and the disk or pads 46 therein. A pair of rings 48 and 50 fixedly secured to the lower tube portion 38 confine the clamp 47 to a location over the opening and disks or pads. A clamp adjustment bolt 52 with enlarged knurled knob 54 threads into both sides of the clamp opening. With the disks or pads positioned in the openings 42 and the clamp 46 in place, the turning of knob 54 through threaded nuts 56 at the open end of the clamp 46 causes the disks or pads to be forced against upper tube portion 36 preventing relative translation between the upper and lower tube portions thereby locking the surfaces portions 11A and 11B at a desired elevation relative to the supporting surface.

Referring now to FIG. 11, a locking device 58 is shown in detail. This locking device is employed to lock surface portions in the use position shown in FIGS. 3-5. Surface portion 11A includes a plurality of locking devices, 58 attached thereto (three shown in FIG. 9). Each of the locking devices 58 include a translatable pin 60 with a circumferential groove 63 located on the end thereof adjacent to the matting edge of surface portions 11A and 11B. Positioned adjacent thereto and fixedly attached to surface portions 11B is a locking means. Locking means includes a pivotal arm 62 with an open knotch 64. The arm when pivoted toward the back surface of surface portion 11B causes the knotch 64 to engage groove 63 of translatable pin 61 when translated toward surface 11B thereby locking surface portions 11A and 11B in the use positions shown in FIGS. 3-5. Shoulder portions 60 and 61 provide rigidity to the surface portions 11A and 11B at the connection. Although three locking devices 58 are shown in FIG. 9, any convenient number may be utilized depending on the height of surface portions 11A and 11B and the rigidity required at these joiners. Also the pin 60 and locking arm 62 may be positioned on surface portions 11B and 11A respectively. Likewise arm 62 may be positioned to rotate downward into engagement with pin 60 rather than upward as shown in FIG. 9.

Figure 12:
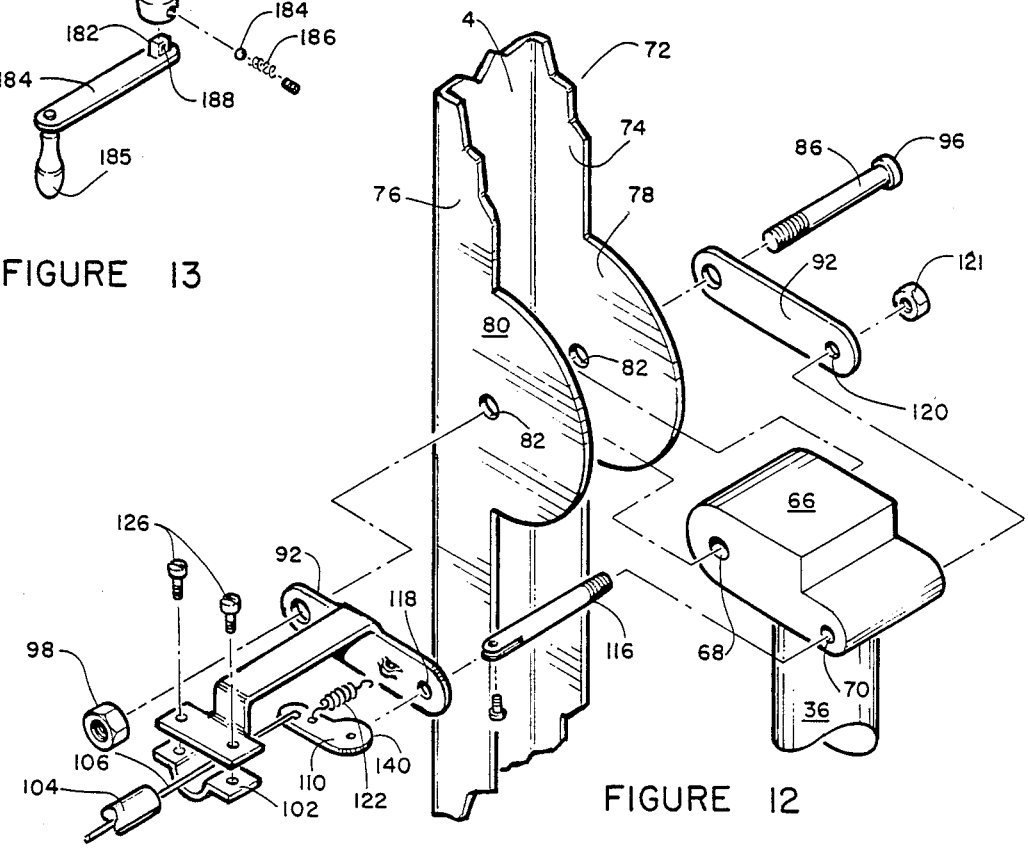
FIG. 12 is a detail of the tilting mechanism of the FIG. 9 showing.

Referring now to FIG. 12, the surface portions tilting mechanism 64 is shown in detail. Each of the surface portions include a similar tilting mechanism. The detail of FIG. 12 depicts the tilting mechanism of surface portion 11A. The tilting mechanism of surface 11B is a mirror image of the tilt mechanism of FIG. 12 that is the locking controls, hereinafter described in detail, are positioned on the opposite side, i.e. facing the locking controls of the FIG. 12 showing (see FIG. 9). A pivot block 66 is fixedly attached to the upper end of upper tube portion 36. The pivot block includes a pair of different sized bores 68 and 70. A bracket 72 is attached to the back surface of surface portion 11, likewise bracket 72 is attached in a similar manner to surface portions 11B. Bracket 72 is in the form of a channel with spaced apart outwardly extending walls 74 and 76. Centrally positioned on walls 74 and 76 are curvilinear extensions 78 and 80 respectfully. Each wall 74 and 76 includes a bore 82 which are in horizontal alignment. Pivot block 66 is sized to rotatably fit within the channel 84 formed between walls 74 and 76 of the bracket 72.

When installed within the channel 84, a connecting pin 86 passes partially through a bore 90 of a link 92, through bore 82 of wall 76 and through bore 92 of link bracket 94. The connecting pin 86 is secured in this position by head 96 and nut 98. At the outer end 100 of link bracket 94 attaches to a "C" bracket clamp 10. The clamp 102 secures the outer housing of a central cable 104. An inner control wire 106 of control cable 104 is pivotly connected to one end 108 of a cam arm 110. The opposite end 112 of the cam arm is pivotly connected to a slot 114 in one end of brake pin 116. The brake pin extends through a bore 118 of link bracket 94, through bore 70 of pivot block 66 and through a bore 130 in link 92. The end of brake pin 116 opposite slot 114 is threaded and secured by a nut 121. The brake pin is held in place by cam arm 110 and nut 121. A coil spring 122 is connected between cam arm 110 and the link portion of link bracket 94. A keeper pin 124 provides the pivot connection between cam arm 110 and brake pin 116. Machine screws 126 or the like secure "C" clamp 102 to the end of pivot bracket 94.

Referring now to FIGS. 9 and 12, cable 104 extends to actuating assembly 128. The outer housing is fixed in position by bracket 130 attached to the back of surface portions 11A and 11B. A cable actuating lever 132 is pivotly attached to a pivot block 134 which is attached to bottom surface 136 of surface portions 11A and 11B. One end of actuating lever 132 serves as an operating surface and the opposite end is connected to bottom surface 136 via a coil spring 138. Intermediate the ends of actuating lever 132 is pivotly connected inter central wire 106 of control cable.

As can be understood, the movement of the handle end of actuating lever 132 toward the bottom surface 136 of surface portions 11A and 11B against the bias of coil spring 138 causes the cam arm 110 to rotate away from bracket 72 and against the bias of coil spring 122. The cam surface 140 of cam arm 110 is formed in a manner whereby the actuation of the activating lever 132 is the manner described effectively lengthens break pin 116 allowing relative rotation between bracket 72 and pivot block 66. The release of actuating lever 132, causes the cam arm 110 to be biased toward bracket 72. The cam surface 140 effectively shortens the length of brake pin 116 causing the ends of link 92 and the link of link bracket 94 adjacent bore 70 of pivot block 66 to act as a clamp preventing relative rotation between bracket 72 and pivot block 66.

Figure 13:
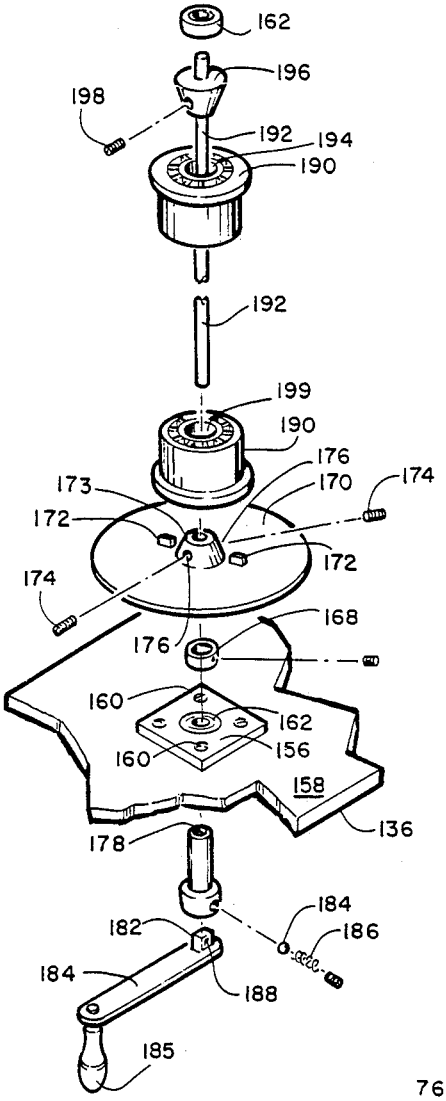
FIG. 13 is an exploded showing of a roller detail of FIG. 9.
Figure 14:
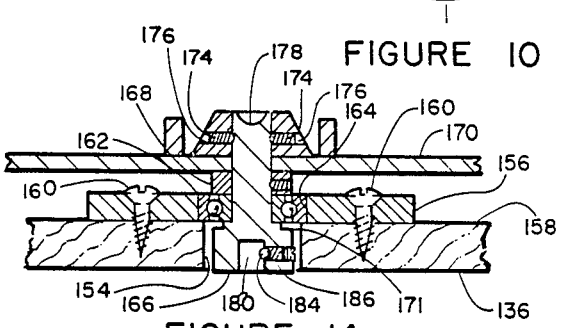
FIG. 14 is a side cutaway showing of a section of FIG. 9 showing roller support.

Referring now to FIGS. 9, 13, and 14, writing material spools 142 and 146, are located on the back of surface portions 11A and 11B respectfully. One of these spools support a continuous roller 148 of writing material 150 and the other is used as a take up spool for storing the used or waste writing material. The writing material 150 spans the front or board surface 152 of surface portions 11A and 11B. An exploded perspective view of a spool assembly is shown in FIG. 13 and a cross section of the lower positions thereof is shown in FIG. 14. A bore 154 is provided through the bottom surface 136 of surface portions 11A and 11B. A plate 156 is attached to the upper or inner surface 158 of bottom surface 136. The attachment means is shown as wood screws 160. Any other suitable attachment means may be employed. A bearing 162 is received in a central aperture 164 in plate 156. An axle 166 passes through the center of bearing 162. A paper support plate 170 with writing material roll engaging members 172 fixed attached to the upper surface, and a frusto conic member 173 fixedly attached to the upper surface of plate is positioned over axle 166 adjacent to spacer 168. Axle 166 is trapped between the bottom of the bearing 162 by a shoulder 171 engagement and at the upper surface of frusto conic member 173 by keeper means 174 readily engaging bore 176 through engaging number 172 bearing against axle 166. Two keeper means are shown. One or more can be employed depending on load expected to be encountered by the axle. The upper end of axle 166 includes a dimple 178 the purpose of which is hereinafter explained. Shoulder 171 includes a rectangular slot 180 for receiving block 182 on the end of a handle 184. A spring loaded ball 184 biased by spring 186 bears against an indentation 188 in the side of block 182. The ball receiving aperture has an end opening slightly smaller than the ball diameter to prevent loss of the ball with the handle 184 removed from slot 180. This type of friction lock is well known in the tool art. The opposite end of handle 184 is a rotatable knob 135 for operating handle 184 as a crank. Rolls of writing material generally include a support member 190 press fit into each end of the roll. If these members 190 are not provided with the roll of writing material they must be first inserted into the roll. The use of members 190 on the waste writing writing material may or may not be required. Rod 192 extends through the central aperture 194 in members 190 when the members 190 are required. One end of the rod 192 is curvilinear and engages the dimple 178 in the upper end of axle 166. The opposite end of the rod has a position adjustable frusto conic member 196 which engages the upper surface of the upper member 190. A threaded bore through the frusto conic member 196 in receives a lock screw 198 which bears against the adjacent axle surface securing the frusto conic member in a selected location along the rod. The width of the writing material determines the position of frusto conic member 196 relation to frusto conic member 173. A bearing 162 is slipped over the upper end of rod 192. This bearing 162 is positioned under the upper extension 200 of "L" bracket 202 in cut out 197 when the spool assembly is installed as shown. Screw adjustments are provided to properly center or align the rod 192 relative to axle 166. Leaf springs 204 maintain tension on the writing material 150 remaining or being deposited on a spool.

The device 10 is stored as shown in FIG. 1. For use the two surface portions 11A and 11B are pivoted about hinge 12 as shown in FIG. 2 by arrows 22 to the FIG. 3 position. Knobs 54 are then turned in a direction for releasing clamp 50 whereby right adjustment is made to support 14. When the proper height is obtained, the clamps are re-tightened preventing relative movement between upper and lower tube portions 36 and 38. Writing material from a spool is fed through slot 206 on the side of the surface portions. The writing material is fed across surface portions 11A and 11B as shown in FIGS. 5 and 6. The free end of the writing material is then fed through the slot 206 on the opposite surface portion and connected to rod 192 of the take up spool, see FIG. 9. The crank handle 184 of the take up spool is then operated to wind the free end of the writing material onto the rod 192. As the device 10 is in use clean writing material can be provided by turning the take up crank handle 184 or previous used writing material can be redisplayed from the take up spool by operation of the crank handle 185 on the supply spool.

The surface portion 11A and 11B can be tilted between substantially vertical to substantially horizontal and locked at any desired angle therebetween by forcing both lever 132 downward against the bias of springs 122 and 132 releasing pivot block 66 through the action of cam 110, rotating the surface portions along arrow head 26A until the desired angle is reached and then releasing levers 132. Movement along arrow head 26 repositions the surface portions toward a more vertical plane.

These operations are reversed to restore the device. The writing material may remain across the surface of the surface of the surface potions where stored. Slack in the writing material will allow for the FIG. 1 configuration.

In the FIG. 5 position the device can be used as a conventional "black board" or the later while in the FIG. 6 position and various positions between FIGS. 5 and 6 position as a drafting table or the like.

In the foregoing description, certain terms have been used for brevity, clearness and understanding; but no unnecessary limitations are to be implied beyond the requirements of the prior art because such terms are used for descriptive purposes and are intended to be broadly construed.

While the invention has been described in terms of certain specific embodiments, it is understood that various modifications and substitutions can be made in any of them within the scope of the appended claims which are intended to include equivalents of such embodiments.

What I claim is:

1. A combined black board and easel device comprising:

first and second writing surfaces;

a hinge means interconnecting said writing surfaces along one edge thereof, said hinge means allows said writing surfaces to pivot between a stowed back to back position and an end to end use position;

writing surface locking means for locking said writing surfaces in said use position;

a pair of writing surface support means, one of which is pivotaly attached to each of said writing surfaces, said writing surface support means are length adjustable;

length locking means on each of said pair of writing surface support means for locking said writing surface support means at a selected length;

pivot means for pivoting said writing surfaces relative to said writing said surface support means; and pivotal locking means for locking said pivot means at a selected angle between said writing surface and support means.

2. The invention as defined in claim 1 further comprising roller means positioned on the distal end of each of said writing surfaces opposite said hinge means and a supply of writing material carried by one of said rollers and extending across said writing surfaces to the other of said rollers as a writing material take up means, the take up roller being rotated to translate the writing material across said writing surfaces.

3. The invention as defined in claim 1 wherein said writing surfaces are formed from rigid flat material.

4. The invention as defined in claim 1 wherein said hinge means extends vertically and said first and second writing surface pivot horizontally about said hinge between stowed and deployed positions.

5. The invention as defined in claim 1 wherein said writing surface locking means comprise a translatable pin connected to the back surface of one of said writing surfaces which is received within a "C" bracket attached to the back surface of the other one of said writing surfaces when the first and second writing surface are in said end to-end use position.

6. The invention as defined in claim 1 wherein said length and pivot locking means are friction locking device.

7. The invention as defined in claim 1 wherein each of said writing surfaces support means comprise a telescopic leg member having first and second tubes one translatably positioned within the other, a coil spring captured within and between the outer ends of said tubes whereby said spring counter balances the weight supported by each leg member, said spring is compressed when said leg member is at its shortest length and extended when said leg member is at any other length.

8. The invention as defined in claim 7 wherein said length locking means clamps one of said tubes relative to the other by friction means.

9. The invention as defined in claim 1 wherein each of said pair of writing surface support means comprises inside and outside tube members which have relative translation.

10. The invention as defined in claim 9 wherein said length locking means comprises a plurality of apertures through said outside most tube, a disk member positioned within each of said apertures and extending from contact with said inside tube member beyond said outside tube member and a clamp means surrounding said disk members which when tightened forces said disk members between said inside tube member and said clamp locking said outside and inside tube together for preventing relative translation therebetween.

11. The invention as defined in claim 2 wherein operating means are provided for rolling said rollers.

12. The invention as defined in claim 11 wherein said operating means is a removable crank member.

13. The invention as defined in claim 1 wherein each of said pair of writing surface support means remote from their pivot attachment include casters adjacent the device support surface whereby said device can be rolled relative to said support surface.

14. The invention as defined in claim 2 wherein pressure means are included to maintain said writing material taught between said rollers.

15. The invention as defined in claim 14 wherein said pressure means comprises leaf springs bearing adjacent said writing material on said rollers.

* * * * *